US006058615A

United States Patent [19]

Uhlmann et al.

[11] Patent Number: 6,058,615

[45] **Date of Patent: *May 9, 2000**

[54] GUN SIGHTS

[75] Inventors: Julius H. Uhlmann, Huntsville; Paul A. Flubacher, Greenville, both of Ala.

[73] Assignees: REF Alabama Inc., Greenville; Highlander Sports, Inc., Huntsville, both of Ala.

[ * ] Notice: This patent issued on a continued prosecution application filed under 37 CFR 1.53(d), and is subject to the twenty year patent term provisions of 35 U.S.C. 154(a)(2).

[21] Appl. No.: 09/038,065

[22] Filed: Mar. 11, 1998

[51] Int. Cl.[7] ..... F41C 3/14; F41G 1/32

[52] U.S. Cl. ..... 33/241; 42/100; 33/261

[58] Field of Search ..... 33/241, 250, 251, 33/252, 246, 261; 42/100, 102, 103

[56] References Cited

U.S. PATENT DOCUMENTS

| | | | |
|---|---|---|---|
| D. 393,306 | 4/1998 | Couper | 33/241 |
| 744,651 | 11/1903 | Vickery | 42/100 |
| 847,643 | 3/1907 | Brockhaus | 33/252 |
| 1,835,938 | 12/1931 | Ewen | 33/261 |
| 2,706,335 | 4/1955 | Munsey | 33/241 |
| 3,098,303 | 7/1963 | Plisk | 33/241 |
| 3,184,851 | 5/1965 | Simmons | 33/241 |
| 3,200,499 | 8/1965 | Kingston | 33/261 |
| 3,218,718 | 11/1965 | Hays | 33/241 |
| 3,820,248 | 6/1974 | Hayward | 42/100 |
| 3,949,482 | 4/1976 | Ross | 33/241 |
| 4,383,371 | 5/1983 | Coffey | 33/245 |
| 4,850,113 | 7/1989 | Doll | 33/261 |
| 4,993,158 | 2/1991 | Santiago | 33/253 |
| 5,065,519 | 11/1991 | Bindon | 33/241 |
| 5,101,589 | 4/1992 | Duncan | 33/241 |
| 5,201,124 | 4/1993 | Sherman | 33/265 |
| 5,359,800 | 11/1994 | Fisher et al. | 33/241 |
| 5,384,980 | 1/1995 | Johnson et al. | 42/100 |
| 5,471,777 | 12/1995 | McDonald | 33/241 |
| 5,519,941 | 5/1996 | Yusko | 33/252 |
| 5,638,604 | 6/1997 | Lorocco | 33/241 |
| 5,685,081 | 11/1997 | Winegar | 33/265 |
| 5,836,100 | 11/1998 | Stover | 42/100 |
| 5,878,521 | 3/1999 | Warnock | 42/103 |

*Primary Examiner*—Charles T. Jordan
*Assistant Examiner*—Denise J Buckley
*Attorney, Agent, or Firm*—Nixon & Vanderhye P.C.

[57] ABSTRACT

Gun sights have a general cross-sectionally semi-circular support member provided with a lengthwise extending arcuate concavity; and a rod-shaped light guide positioned within and fixed to the arcuate concavity of the support member. The semi-circular support member may itself be provided with a generally rectangularly shaped lower channel which is especially adapted to being attached to a gun's vent rib. The semi-circular support member may alternatively be provided as a domed protuberance from a longitudinally split cylindrical band which is adapted to being sleeved over a gun's barrel. One or more of the rod-shaped light guides may be affixed within individual lengthwise concavities, in which case there is most preferably provided a central lengthwise extending concavity therebetween.

3 Claims, 5 Drawing Sheets

GUN SIGHTS

FIELD OF THE INVENTION

The present invention relates generally to sighting devices for personal firearms such as rifles, shotguns, pistols and the like. In preferred embodiments, the present invention relates to gun sights which employ dyed or colored light guides.

BACKGROUND AND SUMMARY OF THE INVENTION

Personal firearms, such as rifles, shotguns and pistols are typically aimed at targets using some form of sighting device which is fixed to the gun in alignment with the sight line of the gun barrel. In such a manner, the gun's barrel may be brought to bear on a visually acquired target so that a high likelihood exists that the target will be hit when the gun is discharged.

In order to improve the sight qualities, there have been numerous proposals in the past to include a fluorescently dyed polymeric light guide or rod in operative association with a variety of sighting devices, as evidenced by U.S. Pat. No. 2,706,335 to Munsey; U.S. Pat. No. 3,098,303 to Plisk; U.S. Pat. No. 3,949,482 to Ross; U.S. Pat. No. 4,993,158 to Santiago; U.S. Pat. No. 5,638,604 to Lorocco; and U.S. Pat. No. 5,685,081 to Winegar. The mounting structures of such prior art sights, however, are not convenient to the user and do not readily allow for field modifications and/or adjustments—particularly with respect to windage compensations.

Broadly, the present invention is embodied in gun sights having a generally semi-circular support member in cross-section provided with a lengthwise extending arcuate concavity; and a rod-shaped light guide positioned within and fixed to the arcuate concavity of the support member. The semi-circular support member may itself be provided with a generally rectangularly shaped lower channel which is especially adapted to being attached to a gun's vent rib. The semi-circular support member may alternatively be provided as a domed protuberance from a longitudinally split cylindrical band which is adapted to being sleeved over a gun's barrel. One or more of the rod-shaped light guides may be affixed within individual lengthwise concavities, in which case there is most preferably provided a central lengthwise extending concavity therebetween.

These and other aspects and advantages of the present invention will become more clear after careful consideration is given to the following detailed description of the preferred exemplary embodiments thereof.

BRIEF DESCRIPTION OF THE ACCOMPANYING DRAWINGS

Reference will hereinafter be made to the accompanying drawings wherein like reference numerals throughout the various FIGURES denote like structural elements, and wherein, FIG. 1 is a side elevational view of a shoulder-mounted personal firearm which is provided with front and rear gun sights in accordance with the present invention;

DETAILED DESCRIPTION OF THE INVENTION

Figure 1:
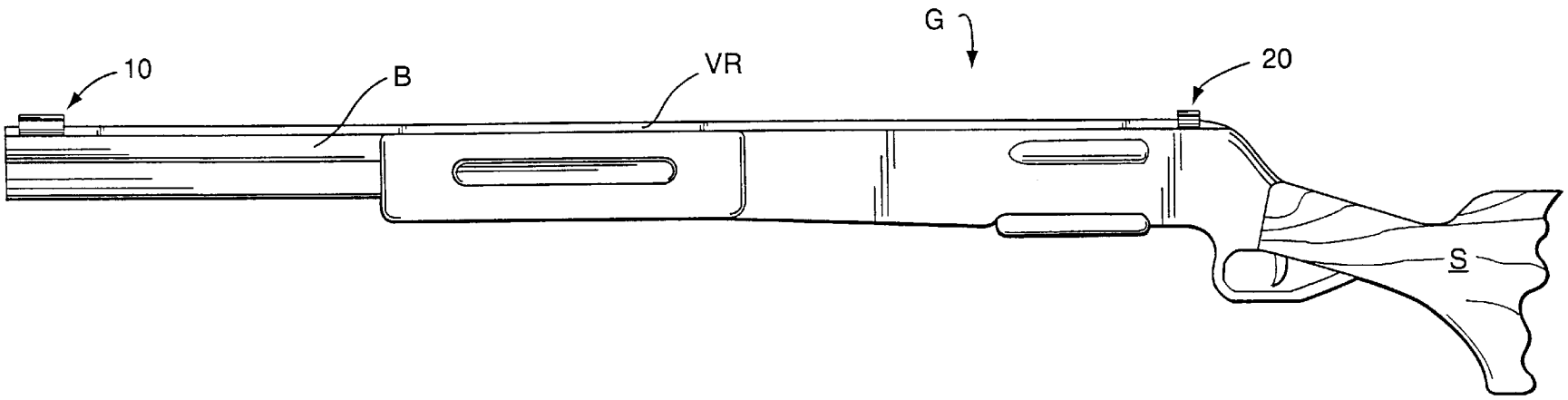

Front and rear gun sights 10, 20, respectively, in accordance with one embodiment of the present invention are shown in accompanying FIG. 1 positioned along the sight line of a typical shoulder-mounted personal firearm or gun G. In this regard, it will be appreciated that, although the sights 10, 20 in accordance with the present invention are depicted in FIG. 1 as being mounted to a shoulder-mounted gun G (e.g., a rifle, shotgun or the like) and will be described in greater detail in the environment of use, it will of course be understood that the gun sights disclosed hereinafter also find utility when combined with non-shoulder-mounted firearms (e.g., pistols).

It will be observed that the front sight 10 is positioned along the raised vent rib VR of the gun G near the forward end of its barrel B. The rear gun sight 20 on the other hand is mounted to the vent rib VR nearer the stock S of the gun G so that it is in alignment with the sight line of the gun generally defined by the vent rib VR. In such a manner, the user of the gun G will be able to bring the barrel B of the gun to bear accurately on a visually acquired target by bringing the front and rear sights 10, 20, respectively, into alignment with one another and with the target. By aiming the gun G in this way, the user will have a high probability of: striking the target when the gun G is discharged.

Figure 2B:
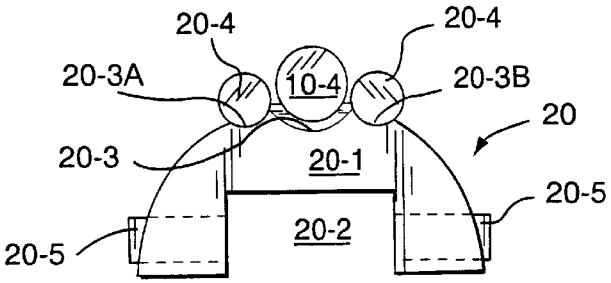
FIG. 2B is a rear end elevational view of the aligned front and rear gun sights shown in FIG. 2A.
Figure 2A:
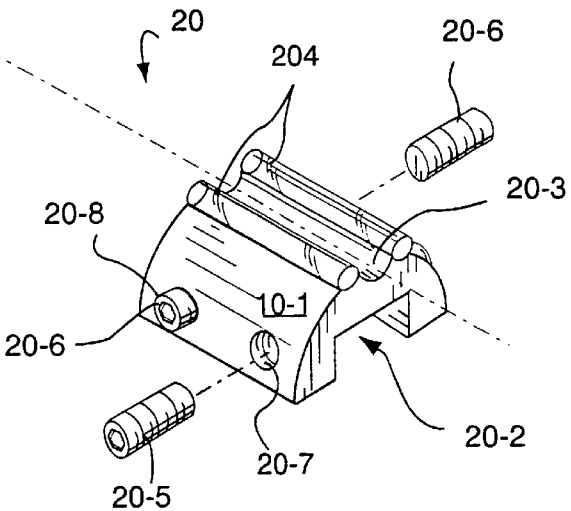
FIG. 2A is a perspective view of an exemplary embodiment of front and rear gun sights in accordance with the present invention.
Figure 2A:
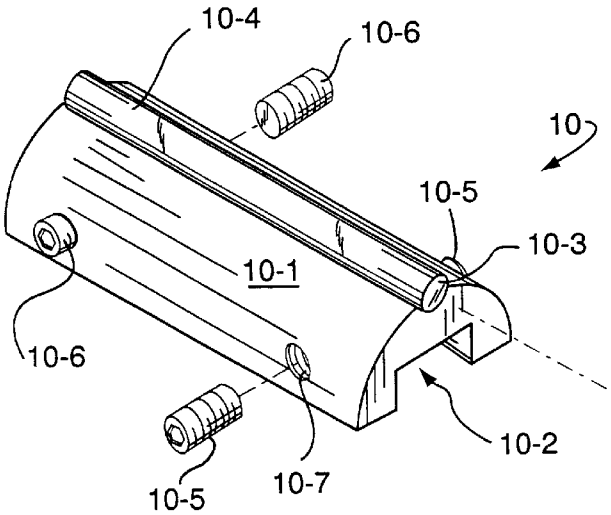

The gun sights 10, 20 are shown in greater detail in accompanying FIG. 2. In this regard, it will be observed that the front gun sight 10 is provided with an elongate support saddle 10-1 having an arcuately convex outer surface. More specifically, the support saddle 10-1 is most preferably has a semi-circular latitudinal cross-sectional configuration with a lower, generally rectangularly shaped channel 10-2 extending along its entire longitudinal extent. The dimensions of the channel 10-2 are provided so as to accept therewithin the vent rib VR of the gun G. In such a manner, the support saddle 10-1 is positioned directly on, and supported by, the vent rib VR of the gun G. The support saddle 10-1 is most preferably formed of lightweight rigid extruded aluminum (e.g. , 6061 T6 aluminum alloy). However, other rigid metals and plastics materials may likewise be employed in the fabrication of support saddle 10-1.

The support saddle 10-1 includes a concave recess 10-3 formed at the apex of the support's outer surface and extending the entire longitudinal extent thereof. The concave recess 10-3 is sized so as to conform closely to the generatrices of the cylindrical light pipe or guide 10-4 and thus has substantially the same radius of curvature as the rod-shaped light guide 10-4. Moreover, the concave recess 10-3 forms in cross-section an arcuate segment of between about 70° to about 180°, and usually between about 90° to about 120°, which segment is thereby in contact with a corresponding circumferential portion of the light guide 104.

The light guide 10-4 may be affixed within the conforming concave recess 10-3 by any suitable means, such as an adhesive. The remainder of the circumferential surface of the light guide 10-4 is thus exposed to ambient light.

Figure 3:
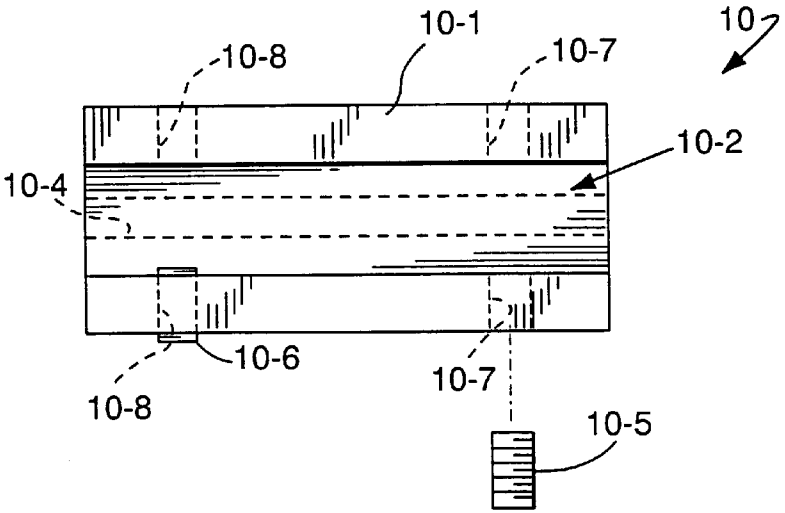
FIG. 3 is a bottom plan view of the exemplary front gun fight depicted in FIG. 2.
Figure 4:
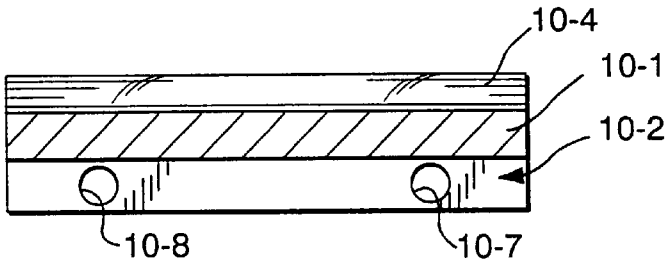
FIG. 4 is a longitudinal cross-sectional elevational view of the exemplary front gun sight shown in FIG. 2 as taken along line 4—4 therein.
Figure 5:
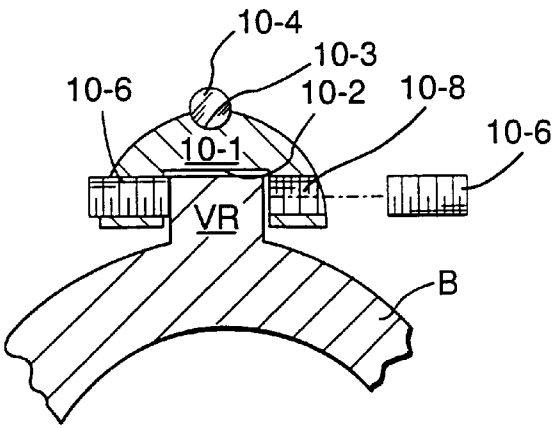
FIG. 5 is a latitudinal cross-sectional elevational view of the exemplary front gun sight shown in FIG. 2 as taken along line 5—5 therein and shown in the process of being mounted to the barrel of the firearm.

The support saddle 10-1 is provided with opposed pairs of set screws 10-5, 10-6 which are threadably received within corresponding threaded apertures 10-7, 10-8, respectively (see FIGS. 3–5). The threaded apertures 10-7, 10-8 extend substantially perpendicularly to the longitudinal dimension of the channel 10-2 and thereby allow their respective set screws 10-5, 10-6 to extend into the channel 10-2. The proximal end of the set screws 10-5, 10-6 is thus provided with suitable surfaces (which in the embodiment shown just happens to be a recessed hex-head surface) to accept a turning tool therewithin. The distal ends of the set screws 10-5, 10-6 are therefore capable of entering the channel 10-2 and bearing against the vent rib VR of the gun G so as to positionally fix the support saddle 10-1, and hence the sight 10, thereto.

As shown perhaps more clearly in accompanying FIG. 5, the vent rib VR is received within the longitudinal channel 10-2 of the support saddle 10-1. In this regard, the channel 10-2 is sized and configured so that a slight, but meaningful, clearance space exists between the lateral sides of the channel 10-2 and the vent rib VR of the gun G. As was mentioned previously, the distal ends of the set screws 10-5 and 10-6 may be brought to bear frictionally against the sides of the vent rib VR so as to positionally lock or fix the front sight 10 thereto. In addition, because of the clearance space that exists, the pairs of set screws 10-5, 10-6 can be selectively tightened and/or differentially adjusted. Since the pairs of set screws 10-5, 10-6 are longitudinally separated from one another, such differential tightening will cause the support saddle to be slightly skewed relative to the centerline of the vent rib VR (which slight skewing is allowed by virtue of the slight, but meaningful clearance space mentioned previously). Thus, windage corrections and sight alignment adjustments can be made by virtue of the pairs of set screws 10-5, 10-6.

The rear sight 20 depicted in FIG. 2 is generally structurally similar to the front sight 10 discussed above. In this regard, it will be noted that, like the front sight 10, the rear sight 20 includes a generally semi-circular cross-sectionally shaped support saddle 20-1 which defines a rectangular lower channel 10-2 extending its entire longitudinal extent. Preferably, the rear sight 20 is generally about one-half the longitudinal dimension of the front sight 10, but clearly other dimensional relationships could be employed.

At the apex of its outer surface, the support saddle 20-1 includes a longitudinally extending central concave recessed surface 20-3. A pair of concave recessed surfaces 20-3A and 20-3B are disposed parallel to the central concave surface 20-3 so as to laterally border the same. The lateral concave surfaces 20-3A and 20-3B each receive a respective one of the rear pair of light guides 20-4 and, like the concave surface 10-3 discussed previously, are most preferably substantially the same radius of curvature as their associated light guides. The concave surfaces 20-3A and 20-3B also most preferably establish an angular segment of between about 70° to about 180° which is in contact with the associated light guides 20-4, it being understood that the remainder of the circumferential surface of the light guides 20-4 is exposed to ambient light.

The rear sight includes pairs of longitudinally separated set screws 20-5, 20-6 which are threadably received within respective ones of threaded apertures 20-7, 20-8. In a manner similar to front sight 10, therefore, the alignment of the rear light guides 20-4 can be skewed somewhat relative to the centerline of the vent rib VR to which the sight is attached to allow for windage corrections.

As shown in FIG. 2B, the central recessed concave surface 20-3 is sized so as to allow the light guide 10-4 to be clearly visible when the user views it from the rear of the sight 20. In this regard, it will be noted that the relative diameters of the light guides 10-4 and 20-4 are different. More specifically, the diameters of the front light guide 10-4 is approximately twice the diameters of the rear light guides. Thus, when the front and rear sights 10 and 20, respectively, are longitudinally separated along the barrel B of the gun G as shown in FIG. 1, the perceived diameter of the front light guide 10-4 will decrease so that it visually appears to be substantially the same diameter as the pair of rear light guides 20-4. In other words, FIG. 2B shows the literal non-perspective dimensional relationship between the light guides 10-4 and 20-4. In use, the sight picture will be such that the front light guide 10-4 will appear to have substantially the same diameter as the light guides 20-4 since the front and rear sights will be viewed in a background/foreground perspective. The relative diameters of the front and rear light guides 10-4 and 20-4 can therefore be selected in dependence upon their relative separation distance when positioned on a firearm so that the relative diameters of the front and rear light guides 10-4 and 20-4 will visually appear to be substantially the same when a user aims the firearm.

Figure 6:
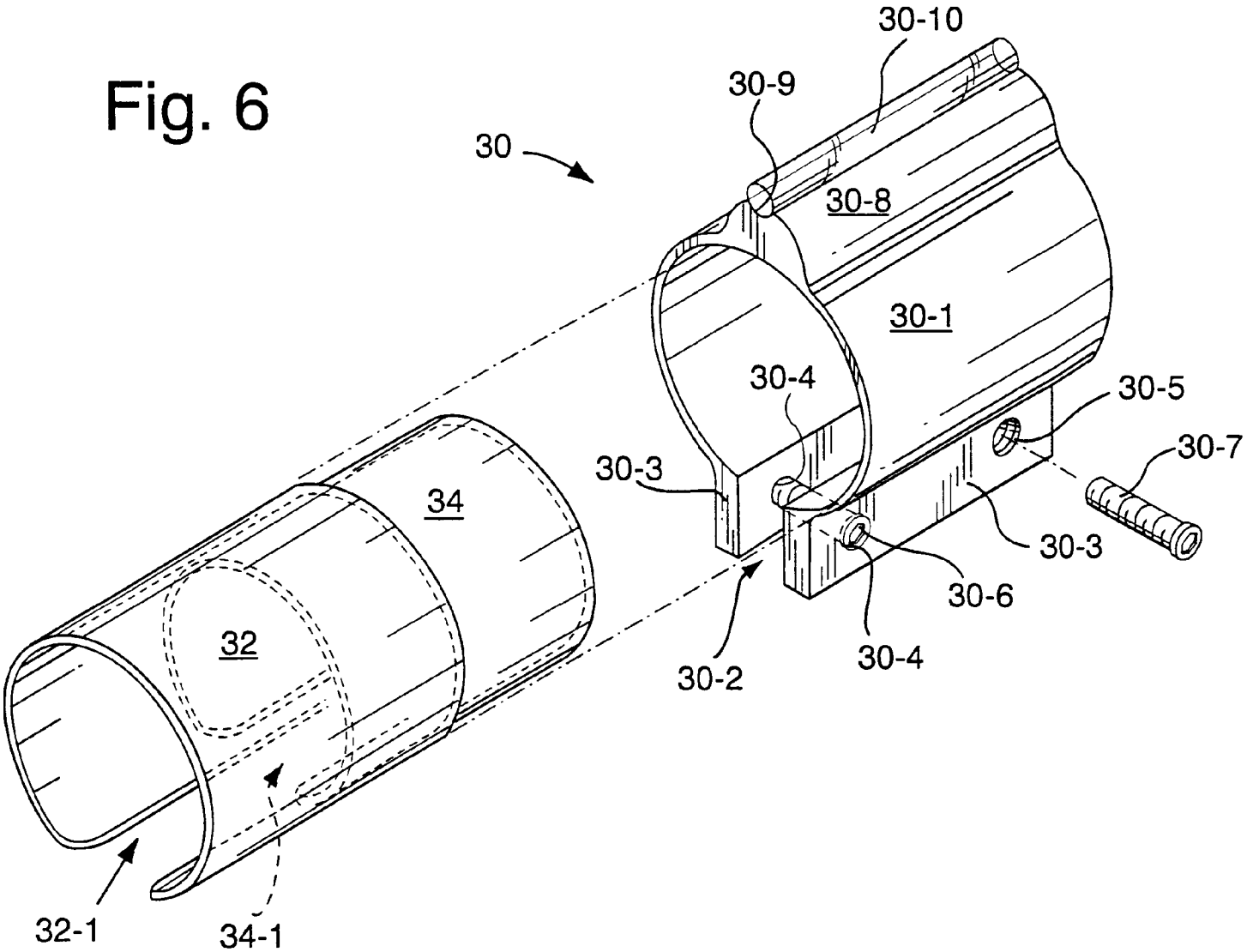
FIG. 6 is an exploded perspective view of another embodiment of a gun sight in accordance with the present invention.

Accompanying FIG. 6 shows another embodiment of a gun sight 30 in accordance with the present invention. Specifically, the sight 30 shown in FIG. 6 includes a cylindrical support band 30-1 which is longitudinally split to form a longitudinal channel 30-2 into the interior of the band 30-1. An opposed vertically oriented pair of lower longitudinal flanges 30-3 are provided in parallel relationship to one another adjacent the channel 30-2. The flanges 30-3 include an aligned pair of threaded apertures 30-4, 30-5 each of which receives a respective one of the set screws 30-6, 30-7.

A generally cross-sectional semi-circular dome-shaped support 30-8 is positioned diametrically opposite to the channel 10-2 and extends the entire longitudinal extent of the band 30-1. The domed support 30-8 is provided with a longitudinally extending arcuate concavity 30-9 which receives a length of a rod-shaped light guide 30-10 in a manner similar to that described with respect to the other embodiments above. In this regard, the light guide 30-10 is most preferably adhesively affixed within the concavity 30-9.

Most preferably, the flanges 30-3 and the domed support 30-8 are unitarily integral with the support band 30-1. That is, the support band, flanges 30-3 and domed support 30-8 are most preferably formed as a one piece structure, for example, for a length of appropriately extruded lightweight metal (e.g., aluminum) or plastics material. Alternatively, these structural components could be manufactured separately and then rigidly assembled together in an integral fashion using appropriate adhesive, soldering and/or welding techniques.

As can be appreciated, the gun sight 30 depicted in FIG. 6 is most suitably used in combination with firearms having a smooth external barrel. If needed, however, one or more generally C-shaped spacer sleeves 32, 34 may be provided so as to permit the sight 30 to accommodate a variety of gun barrel diameters. The sleeves 32 and/or 34 may thus first be positioned over the barrel by forcing the gun barrel through the longitudinal splits 32-1 and/or 34-1, respectively.

Thereafter, the support band 30-1 may be sleeved over the spacers 32 and/or 34. The set screws 30-6 and 30-7 may then be threadably inserted into the aperture pairs 30-4 and 30-6, respectively, so as to tighten the band circumferentially about the gun barrel and positionally hold it in place.

Figure 7:
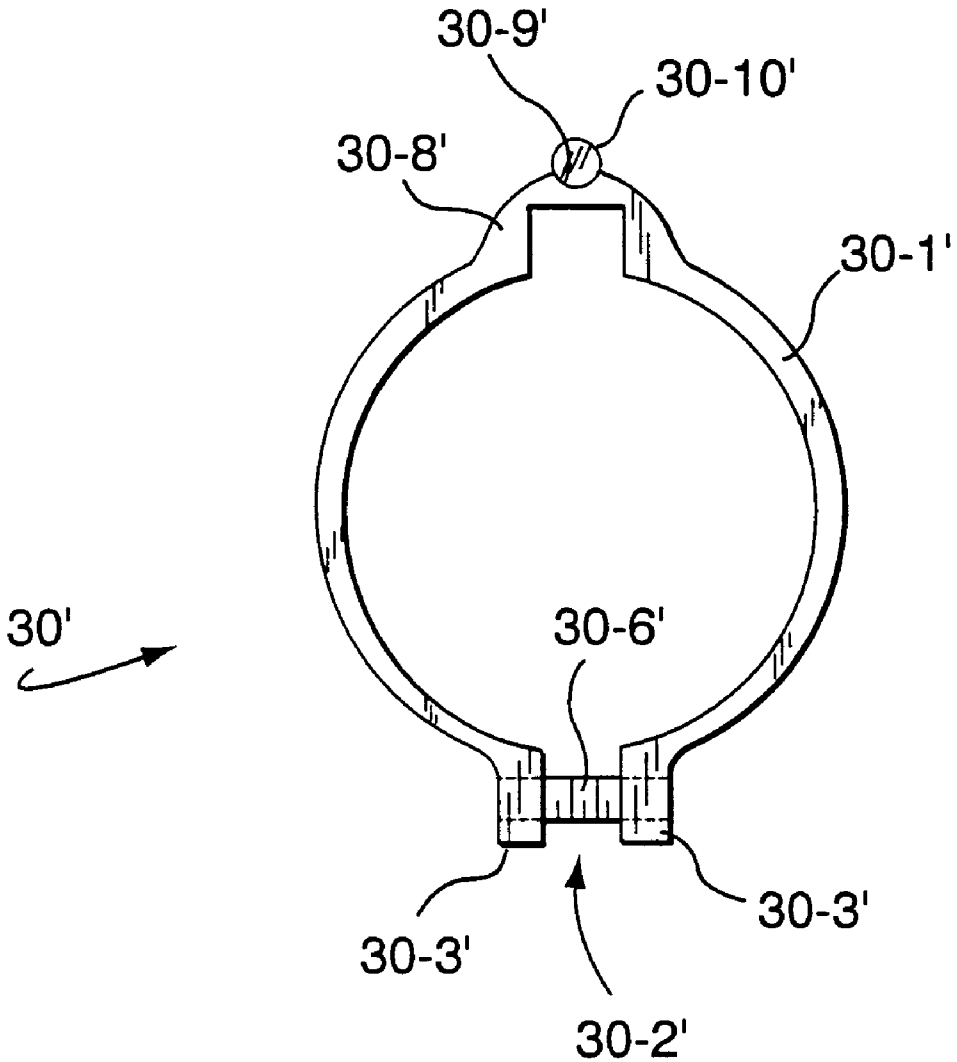
FIG. 7 is an end elevational view of a further embodiment of a gun sight in accordance with the present invention.

The gun sight 30' shown in FIG. 7 is substantially identical to the gun sight 30 depicted in FIG. 6 and thus all corresponding structural elements therein will use the same reference numerals except with a prime (') designation. These corresponding structures will thus not be further explained here. Unlike the gun sight 30, however, the gun sight 30' is provided with a longitudinally extending channel 36 which is sized and configured to accept a vent rib VR or other structural member extending upwardly from the gun barrel.

The light guides employed in the gun sights of the present invention are, in and of themselves, highly conventional. In this regard, the light guides are typically formed from a suitable optically clear plastics material such as polystyrene, polyacrylic or polytetrafluoroethylene, and are most preferably dyed or colored with a fluorescent pigment to enhance their visibility. The light guide may optionally be provided with an optically transparent coating thereon of a suitable plastics material and/or may be provided with a scratch-resistant sleeve member. The light guides are rod-shaped elements having lengths between about 0.50 to about 1.5 inches and a diameter between about 0.055 to about 0.250 inch and more preferably between about 0.075 to about 0.125 inch. In particularly preferred embodiments, the light guides for the front and rear sights 10, 20, respectively, will be between about 0.60 and about 1.40 inch in length (±0.015 inch) and will have diameters ranging between about 0.090 to about 0.118 inch (±0.004 inch).

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A gun sight system comprised of front and rear sights for mounting at front and rear sighting positions on a gun, wherein (i) said front sight includes, a generally cross-sectionally semi-circular domed front support member having a lengthwise extending arcuate front concavity formed at an apical location thereon; and a rod-shaped front light guide formed of an optically transparent plastics material having a lengthwise portion of its circumferential surface positioned within, and fixed to, the arcuate front concavity of said support member; and wherein (ii) said rear sight includes, a support member having a lengthwise extending arcuate central concavity and a pair of rear concavities extending parallel to, and on either lateral side of, said central concavity, and a pair of rod-shaped rear light guides each formed of an optically transparent plastics material having a lengthwise portion of its circumferential surface positioned in, and fixed to, a respective one of said rear concavities, wherein said arcuate central concavity allows said front light guide to be visibly perceived between said pair of rear light guides when said front and rear sights are brought into aiming alignment, and wherein the front light guide has a diameter which is greater than diameters of the rear light guides such that the diameters of said front and rear light guides are visually perceived to be substantially the same when said the front and rear gun sights are positioned on the front and rear sighting positions of the gun and viewed in a foreground/background perspective, respectively.

2. The gun sight system of claim 1, wherein each of said front and rear light guides is formed of a rod-shaped fluorescently dyed transparent plastics material.

3. The gun sight system of claim 1, wherein the diameter of the front light guide is about twice the diameters of the rear light guides.

* * * * *